US010431194B2

(12) United States Patent
May

(10) Patent No.: US 10,431,194 B2
(45) Date of Patent: Oct. 1, 2019

(54) ACOUSTIC SENSORS OPTIMALLY PLACED AND COUPLED TO MINIMIZE FEEDBACK AND MAXIMIZE SOUND QUALITY OF AN ACOUSTIC-ELECTRIC STRINGED INSTRUMENT

(71) Applicant: James T. May, Nevada City, CA (US)

(72) Inventor: James T. May, Nevada City, CA (US)

( * ) Notice: Subject to any disclaimer, the term of this patent is extended or adjusted under 35 U.S.C. 154(b) by 0 days.

(21) Appl. No.: 16/114,441

(22) Filed: Aug. 28, 2018

(65) Prior Publication Data

US 2019/0096375 A1 Mar. 28, 2019

Related U.S. Application Data

(60) Provisional application No. 62/679,634, filed on Jun. 1, 2018, provisional application No. 62/561,951, filed on Sep. 22, 2017.

(51) Int. Cl.
*G10H 3/00* (2006.01)
*G10H 3/26* (2006.01)
(Continued)

(52) U.S. Cl.
CPC ..... *G10H 3/26* (2013.01); *G10D 1/085* (2013.01); *G10H 3/143* (2013.01); *G10H 3/146* (2013.01);
(Continued)

(58) Field of Classification Search
CPC ..... G10H 3/26; G10H 3/185; G10H 3/143; G10H 3/146; G10H 2220/525; G10H 2220/465; G10D 1/085
(Continued)

(56) References Cited

U.S. PATENT DOCUMENTS 4,394,830 A 7/1983 Damiano
4,491,051 A 1/1985 Barcus
(Continued)

FOREIGN PATENT DOCUMENTS

WO 2019/060748 A1 3/2019

OTHER PUBLICATIONS

Attenuators. Electronic Instrumentation [online]. EEEGuide.com, 2014 [retrieved on Jun. 27, 2018]. Retrieved from the Internet: <URL: http://www.eeeguide.com/attenuators/>.
(Continued)

*Primary Examiner* — Jeffrey Donels
(74) *Attorney, Agent, or Firm* — Craige Thompson; Thompson Patent Law; Vincent Musgrove

(57) ABSTRACT

Apparatus and associated methods relate to acoustic-electric sensor system including a main acoustic sensor operably coupled to detect string vibrations of an acoustic-electric instrument and a feedback suppression acoustic sensor configured to primarily detect sound board vibrations of the acoustic-electric stringed instrument at a location with a substantially attenuated string vibration signal relative to its sound board vibration signal. In an illustrative example, a mixing circuit may at least partially cancel out sound board vibration signatures output by the main and feedback suppression acoustic sensors with one another to produce a mixed output signal. The feedback suppression acoustic sensor may be spaced outside of an ellipse substantially centered around a sound board string coupling point. The main acoustic sensor may be arranged in close proximity to receive the string vibration signal. The mixed output signal may substantially reject audio feedback disturbances while retaining the unique characteristic sound of the instrument.

19 Claims, 9 Drawing Sheets

(51) Int. Cl.
*G10H 3/18* (2006.01)
*G10H 3/14* (2006.01)
*G10D 1/08* (2006.01)

(52) U.S. Cl.
CPC ..... *G10H 3/185* (2013.01); *G10H 2220/465* (2013.01); *G10H 2220/525* (2013.01)

(58) Field of Classification Search
USPC ..... 84/723
See application file for complete search history.

(56) References Cited

U.S. PATENT DOCUMENTS 4,903,566 A * 2/1990 McClish ..... G10H 3/185 84/734
4,911,054 A 3/1990 McClish
5,410,607 A 4/1995 Mason et al.
5,557,058 A 9/1996 Lace
5,937,070 A * 8/1999 Todter ..... G10K 11/178 381/71.6
6,191,350 B1 2/2001 Okulov et al.
6,320,113 B1 11/2001 Griffin et al.
7,235,734 B2 6/2007 Hosler
7,271,332 B2 9/2007 Clark
2002/0198690 A1* 12/2002 Holzrichter ..... G01H 1/12 702/195
2004/0134330 A1 7/2004 Braun et al.
2004/0134334 A1 7/2004 Baggs
2005/0252363 A1 11/2005 Rockett
2017/0076705 A1 3/2017 Iori et al.
2018/0330703 A1* 11/2018 Ekuni ..... G10H 1/0091

OTHER PUBLICATIONS

International Search Report in related International Application No. PCT/US18/52251; dated Jan. 15, 2019; 3 pages.
Written Opinion of the International Searching Authority in related International Application No. PCT/US18/52251; dated Jan. 15, 2019; 7 pages.

* cited by examiner

ACOUSTIC SENSORS OPTIMALLY PLACED AND COUPLED TO MINIMIZE FEEDBACK AND MAXIMIZE SOUND QUALITY OF AN ACOUSTIC-ELECTRIC STRINGED INSTRUMENT

CROSS-REFERENCE TO RELATED APPLICATIONS

This application claims the benefit of U.S. Provisional Application Ser. No. 62/679,634 titled "Passive Attenuator for Piezo Transducers," filed by James T. May on Jun. 1, 2018. This application also claims the benefit of U.S. Provisional Application Ser. No. 62/561,951 titled "Feedback Suppressing Sound Board Pickup," filed by James S. May on Sep. 22, 2017.

This application incorporates the entire contents of the foregoing application(s) herein by reference.

TECHNICAL FIELD

Various embodiments relate generally to acoustic-electric instruments.

BACKGROUND

Acoustic instruments are instruments that produce sound waves through acoustic means. Some examples of acoustic instruments include drums, pianos, and guitars. Some acoustic instruments may be stringed instruments. For example, acoustic guitars, ukuleles, sitars, banjos, and mandolins are all different types of stringed acoustic instruments. Various stringed instruments may have strings of different lengths and sizes, which may determine the frequency or musical note produced by the vibration of a specific string. The tonal sound of an acoustic instrument may be determined by a number of factors, including the size of the instrument, the material of which the instrument is made (e.g., wood vs. carbon fiber), the shape of the cavity in the body of the instrument, and choice of strings (e.g., metal vs. nylon).

Acoustic-electric instruments are acoustic instruments that are modified with electrical components. Some acoustic-electric instruments may have built-in electronic components, while other acoustic-electric instruments may be modified with modular or removable electronic components. Some acoustic-electric guitars may be fitted with a magnetic pickup, a piezoelectric pickup, or a microphone, for example. Various acoustic-electric instruments may require a power source on board the instrument (e.g., a battery), while other acoustic-electric instruments may rely on an external power supply. An electric-acoustic instrument may include a connector configured to send a signal to an amplifier that may amplify the sound of the instrument. Acoustic-electric instruments may be used instead of purely electric instruments (e.g., an electric guitar) because of the unique characteristic sound of the acoustic-electric instrument. As with purely acoustic instruments, the tonal sound of an acoustic-electric instrument may be determined by a number of factors (e.g., the material of the instrument, etc.). For example, the Ovation® Roundback developed by Charles Hancock Kaman was built from fiberglass (based on his research as an aerospace engineer), and included electrical pickups to provide for the option of amplification.

SUMMARY

Apparatus and associated methods relate to acoustic-electric sensor system including a main acoustic sensor operably coupled to detect string vibrations of an acoustic-electric instrument and a feedback suppression acoustic sensor configured to primarily detect sound board vibrations of the acoustic-electric stringed instrument at a location with a substantially attenuated string vibration signal relative to its sound board vibration signal. In an illustrative example, a mixing circuit may at least partially cancel out sound board vibration signatures output by the main and feedback suppression acoustic sensors with one another to produce a mixed output signal. The feedback suppression acoustic sensor may be spaced outside of an ellipse substantially centered around a sound board string coupling point. The main acoustic sensor may be arranged in close proximity to receive the string vibration signal. The mixed output signal may substantially reject audio feedback disturbances while retaining the unique characteristic sound of the instrument.

Various embodiments may achieve one or more advantages. For example, some embodiments may take advantage of the principle of signal cancellation to substantially reduce or eliminate the feedback caused by the interaction between the sound board of the instrument, the acoustic sensors, and an amplifier. Some implementations may include an acoustic guitar pickup that offers the richness of a soundboard sensor (SBT) with the feedback immunity of a undersaddle sensor (UST). In various examples, the acoustic-electric sensor system may provide a unique solution for a musician that desires both quality sound and elevated volume/amplification levels. The system may retain a great sound while substantially eliminating unwanted muddy and booming tones on the low-end of the acoustic frequency spectrum. Various embodiments may produce a clear and crisp sound with great articulation and string-to-string balance, which may be highly desirable for professional musicians that play acoustic-electric instruments at live venues. Some implementations may provide a hassle- and noise-free passive pickup that does not require batteries, is minimally intrusive, and possesses a low characteristic output impedance. The system may, for example, advantageously work with a variety of instrument types, such as 6 or 12 string flat top acoustic guitars, nylon string guitars (with or without a bridge plate), archtops, mandolins, and banjos. Various examples may provide for a pickup for acoustic guitars and similar instruments with the rich sound of other sound board pickups, but with greatly enhanced feedback immunity due to leveraging the principles of negative feedback and signal cancellation.

Some embodiments may provide for an elegant, cost effective way of volume control for musical instrument pickup systems using piezoelectric transducers. Various examples may eliminate requirements for a battery and active electronic circuitry. Some advantages of a passive attenuator circuit of some embodiments may include: passive implementation requiring no active circuitry or battery; utilizes low cost, commonly available components; maintains the low impedance nature of the piezoelectric transducers; and does not interfere with the desired frequency response.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
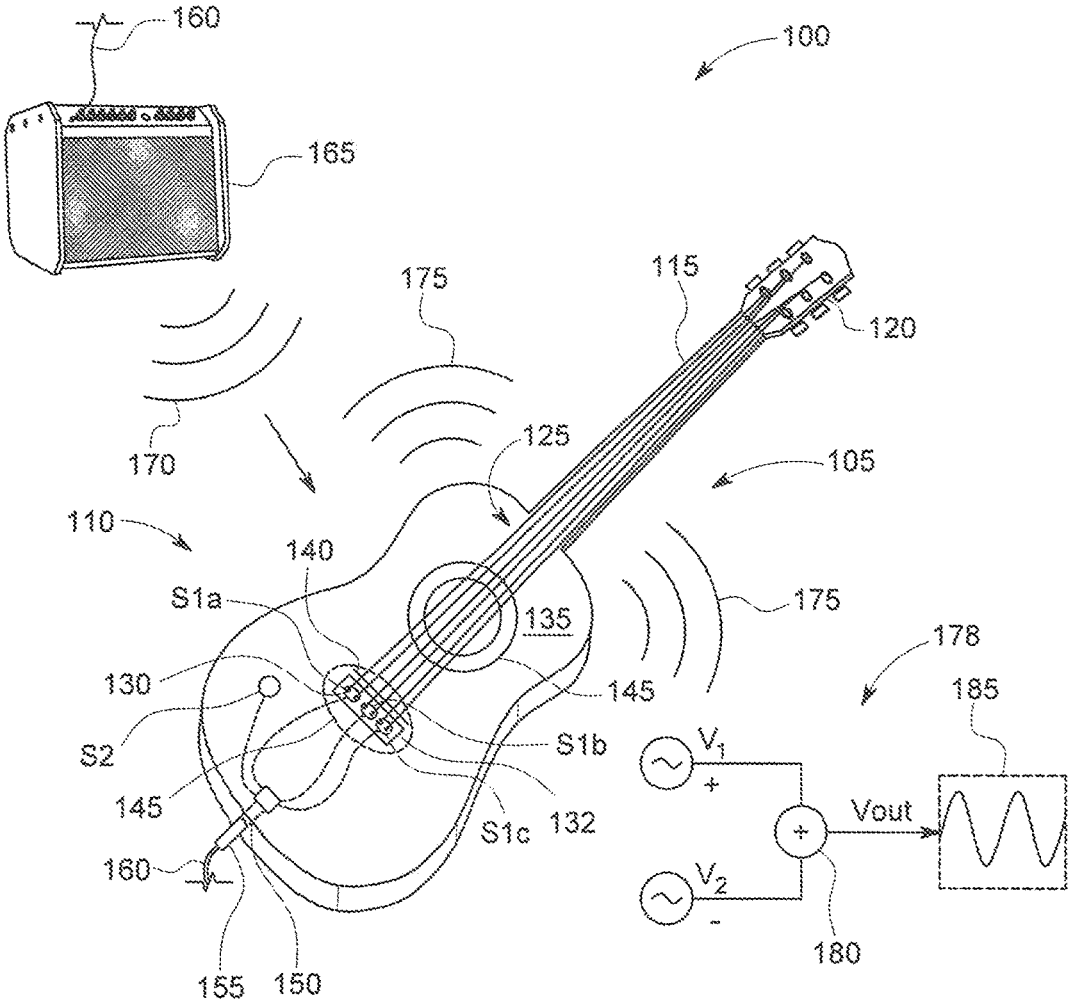
FIG. 1 depicts a perspective view of an exemplary audio feedback scenario that includes a feedback-resistance acoustic-electric stringed instrument.

FIG. 1 depicts a perspective view of an exemplary audio feedback scenario that includes a feedback-resistance acoustic-electric stringed instrument. An audio feedback scenario 100 includes an acoustic-electric stringed instrument 105 (e.g., an acoustic-electric 6-stringed guitar). Operatively coupled proximate to a bridge 132 and/or a saddle 140 of the instrument 105 are main piezoelectric audio transducers S1*a*, S1*b*, and S1*c*. The main transducers S1*a*-S1*c* are configured to detect string vibrations of strings 125 and vibrations of the sound board 135, and output a main electrical signal indicative of an audio signature of these vibrations. Spaced apart from the transducers S1*a*-S1*c* is a feedback suppression piezoelectric audio transducer S2. In various embodiments, S2 may be mounted to generate a signal that is 180° out of phase with S1*a*-S1*c*. This phase inversion may be achieved by, for example, mounting S2 in an opposite orientation relative to S1*a*-S1*c*. For a polarized sensor, the opposite orientation may produce a 180° phase shift between the respective signals output by the transducers S2 and S1*a*-S1*c*. The feedback suppression transducer S2 is configured to primarily detect vibrations of the sound board 135, and output a feedback suppression electrical signal indicative of an audio signature of these vibrations. The respective outputs of the transducers S1*a*-S1*c* and S2 are operatively coupled to a circuit 150, which may combine the outputs to substantially minimize/cancel out any feedback resulting from vibrations of the sound board 135.

In some embodiments, the circuit 150 may be embodied by a printed circuit board (PCB) 150. In some examples, the PCB 150 may be integrated with and/or attached to the body 110 of the instrument 105. In various embodiments, the PCB may be a modular or external component that is separate from the instrument 105. The PCB 150 includes circuitry configured to capacitively couple the outputs of the transducers S1*a*-S1*c* with the output of the transducer S2 to generate an output signal 185, such that the sound board vibration components in the main and feedback suppression signals at least partially cancel out with one another in the output signal 185. The end result of this cancellation is that unwanted feedback (due to sound board vibrations) is minimized in the output signal 185, while the characteristic sound of the string vibrations is retained in the output signal 185. The PCB 150 transmits the output signal 185 to an electrical input connector coupled to an electrical output connector 155 (e.g., a ¼" jack), which sends the signal through a cable 160. The cable 160 is operatively coupled at another end to an amplifier 165, which outputs an audio signal in accordance with the signal content of the output signal 185. In various examples, the audio output of the instrument 105 may be coupled to the amplifier 165 by other methods (e.g., using a wireless system). In various examples, the output signal 185 may be modified before being amplified by the amplifier 165 (e.g., by an effects pedal or equalizer).

A diagram 178 illustrates the above described cancellation concepts in a simplified electrical schematic. V1 may be the voltage source associated with a main transducer S1*a*, S1*b*, or S1*c*, while V2 may be the voltage source associated with a feedback suppression transducer S2. V1 and V2 are input into a summing junction 180, which may be part of the circuit 150. The summing junction 180, in some examples, sums the signals V1 and V2, thus cancelling out the sound board vibration components in each signal V1 and V2. In some embodiments, the signal V2 may be substantially 180° out of phase with, and of opposite polarity with respect to, V1 (where this phase and polarity difference includes sound board frequency component signatures in both V1/V2). The summing junction 180 then generates an output signal VOUT, which may have a waveform 185 that is substantially lacking any audio component associated with sound board vibrations 175 that are caused by impinging sound waves 170 from the amp 165. The waveform 185 may then be transmitted to the amp 165, where it is audibly output without any unwanted feedback that would otherwise degrade the unique characteristic sound of the instrument 105.

The various parts of the instrument 105 may be described as follows. The instrument 105 includes a body 110. Fixedly coupled to the body 110 is a neck 115. At a distal end of the neck is a head 120. Mechanically coupled to respective coupling points (e.g., tuners) at the head 120 are strings 125. The strings are individually mechanically coupled at a distal end to the head 120, and individually mechanically/fixedly coupled at a proximal end to a body string coupling point 130 (which may include, for example, bridge pins to fixedly couple the strings 125 to the bridge 132). Each body string coupling point 130 is located at a bridge 132. The bridge 132 is fixedly coupled to a sound board 135 of the instrument 105. Located proximate to the bridge 132 is a saddle 140. The body 110 also includes a sound hole 145.

Figure 2A:
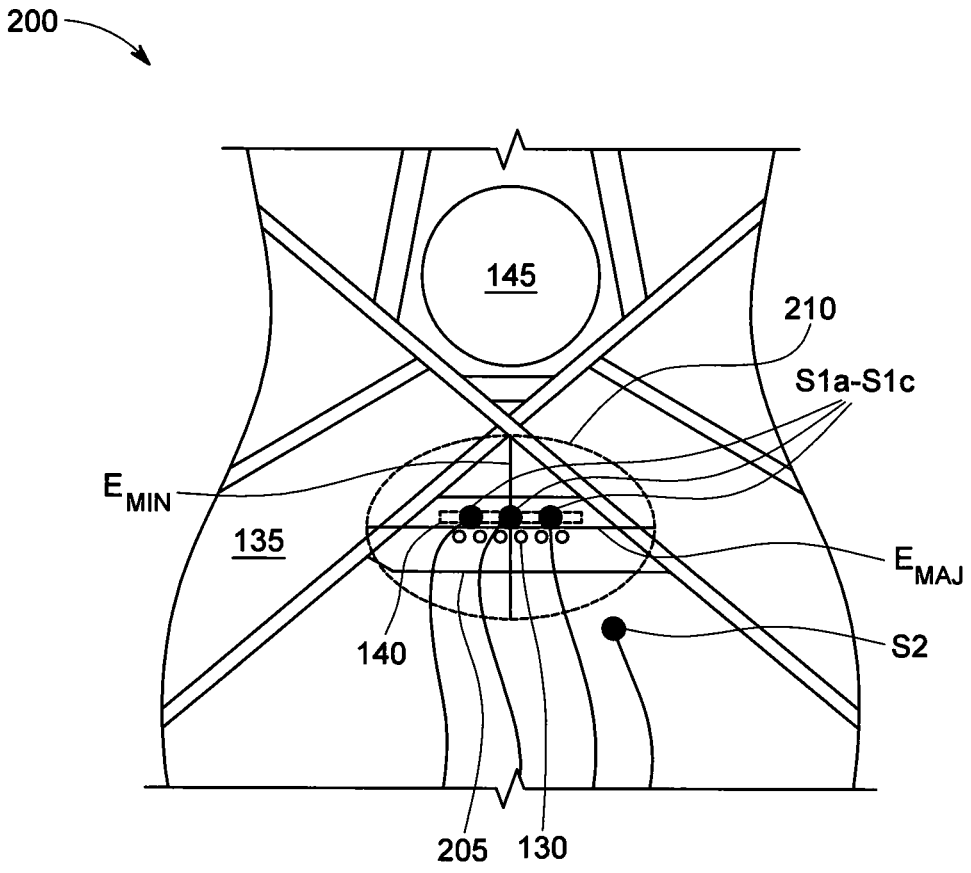
FIGS. 2A and 2B depict bottom views of an exemplary sound board of an exemplary acoustic-electric stringed instrument, which illustrate various audio transducer configurations.
Figure 2B:
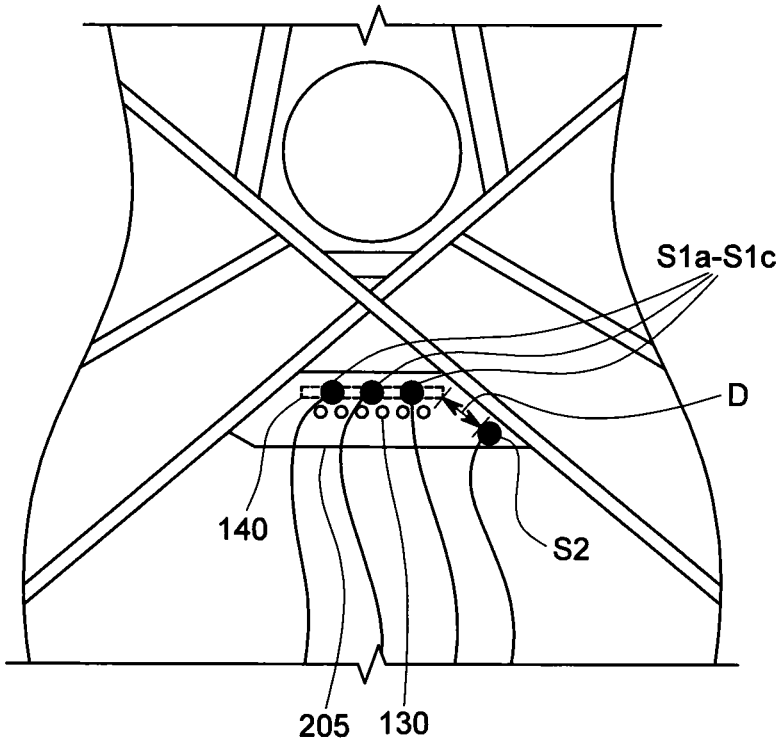

FIGS. 2A and 2B depict bottom views of an exemplary sound board of an exemplary acoustic-electric stringed instrument, which illustrate various audio transducer configurations. These bottom views may detail an exemplary embodiment for how to mount a main sensor and a feedback suppression sensor and couple the outputs of these sensors to achieve substantial cancellation of feedback due to interactions between an amplifier and a sound board of an instrument. A sound board bottom side 200 includes the sound board 135 and the sound hole 145. Arranged in a soundboard transducer (SBT) configuration are three main piezoelectric audio transducers S1*a*, S1*b*, and S1*c*. In some examples, instead of the transducers S1*a*-S1*c* arranged in a SBT configuration, an undersaddle transducer (UST) configuration may be used, where an undersaddle transducer (that is the main sensor) may be located at the location 140. 6 string coupling points 130 are located below the transducers S1*a*-S1*c*. The transducers S1*a*-S1*c* and the string coupling points 130 are located at a bridge plate 205. The feedback suppression audio transducer S2 is located on the sound board bottom side 200. The main pickup(s) S1*a*-S1*c* may include multiple piezoelectric disc sensors. While only three main pickups are depicted in these drawings, any number of main pickups may be used. The main pickups S1*a*-S1*c* may be fixedly attached (e.g., taped or glued) to the bridge plate, for example, right below the spot where the saddle 140 rests upon the top side of the sound board 135.

In the exemplary depiction of FIG. 2A, the transducer S2 is located outside of an ellipse 210 that is substantially centered around the saddle 140. The phrase "substantially centered" may mean in this context that a center point of the ellipse 210 is about 0.5", 0.2", or about 0.1" or less from the center point of the saddle 140. By placing the transducer S2 further away from the string coupling points 130, the saddle 140, and the bridge plate 205, the transducer S2 may primarily detect sound board vibrations while detecting attenuated vibrations of the strings. This may allow the transducer S2 to produce a waveform that is dominated by the sound board vibrations. In contrast, the transducers S1*a*-S1*c* may primarily detect string vibrations, as these transducers directly receive the string vibrations via the saddle 140. Therefore, when the waveform output by the feedback suppression transducer S2 is combined with the waveform output by the main transducer(s) S1*a*-S1*c* to produce the output waveform 185, there will be strong cancellation between the sound board vibration components present in each of the individual waveforms, which may aid in minimizing the amount of feedback created in the system.

In some examples, the ellipse 210 may be an ellipse with a major axis $E_{MAJ}$ and minor axis $E_{MIN}$. The major axis may, for example, be substantially parallel to a lateral dimension of the instrument 105 (e.g., widthwise across the body 110), while the minor axis may, for example, be substantially parallel to a longitudinal dimension of the instrument 105 (e.g., moving from the head 120 along the neck 115 down to the base of the body 110). In some examples, the ellipse 210 may have major and minor axes that are equal to one another (in other words, the ellipse 210 may be a circle). In various examples where the sound board 135 is a flat, planar surface, the ellipse 210 may extend in a plane that is substantially parallel with the plane defined by the sound board 135. In some embodiments where the sound board 135 is a curved or non-planar surface, the ellipse 210 may be projected onto that curved/non-planar surface. The length of the major axis, in some implementations, may be about 2", 3", 4", 5", 6" or more, while the length of the minor axis, in some implementations, may be about 0.5", 0.7", 0.9", 1", 1.5", 2", 3", or about 4" or more. In various examples, the size and dimensions of the ellipse 210 may be a function of the size of the instrument, bridge, bridge plate, and/or saddle (e.g., larger dimensions for a Spanish bass guitar, smaller dimensions for a ukulele). In some examples, the major axis of the ellipse 210 may be about 1, 1.2, 1.5, or about 2 times or more the length of the saddle (moving laterally across the instrument). In various implementations, the minor axis of the ellipse 210 may be about 2, 3, 4, 5, 8, 10, 15, 20, 30, or about 40 times or more the width of the saddle (moving longitudinally across the instrument).

In the exemplary depiction of FIG. 2B, the transducer S2 is located a distance D away from the saddle 140. In this exemplary embodiment, the feedback suppression transducer S2 is located on the bridge plate 205, but may be located elsewhere. In various examples, the distance D may be about 0.2", 0.5", 0.7", 0.9", 1", 1.5", 2", 3", 4", 5", or about 6" or more. Similar to the depiction of FIG. 2A, by placing the transducer S2 further away from the saddle 140, the transducer S2 may primarily detect sound board vibrations while detecting attenuated vibrations of the strings (at the saddle 140), which may allow the transducer S2 produce a waveform that is dominated by sound board vibrations.

In an exemplary embodiment the dimensions of an acoustic-electric system may be as follows. A saddle may have dimensions of about 0.125" in width and about 2.8" in length. A distance D between an end of the saddle to a feedback suppression sensor may be about 0.5" or more. A diameter of a piezoelectric disc sensor may be about 12 mm (e.g., for the main sensor(s)) and/or about 20 mm (e.g., for the feedback suppression sensor).

Figure 3:
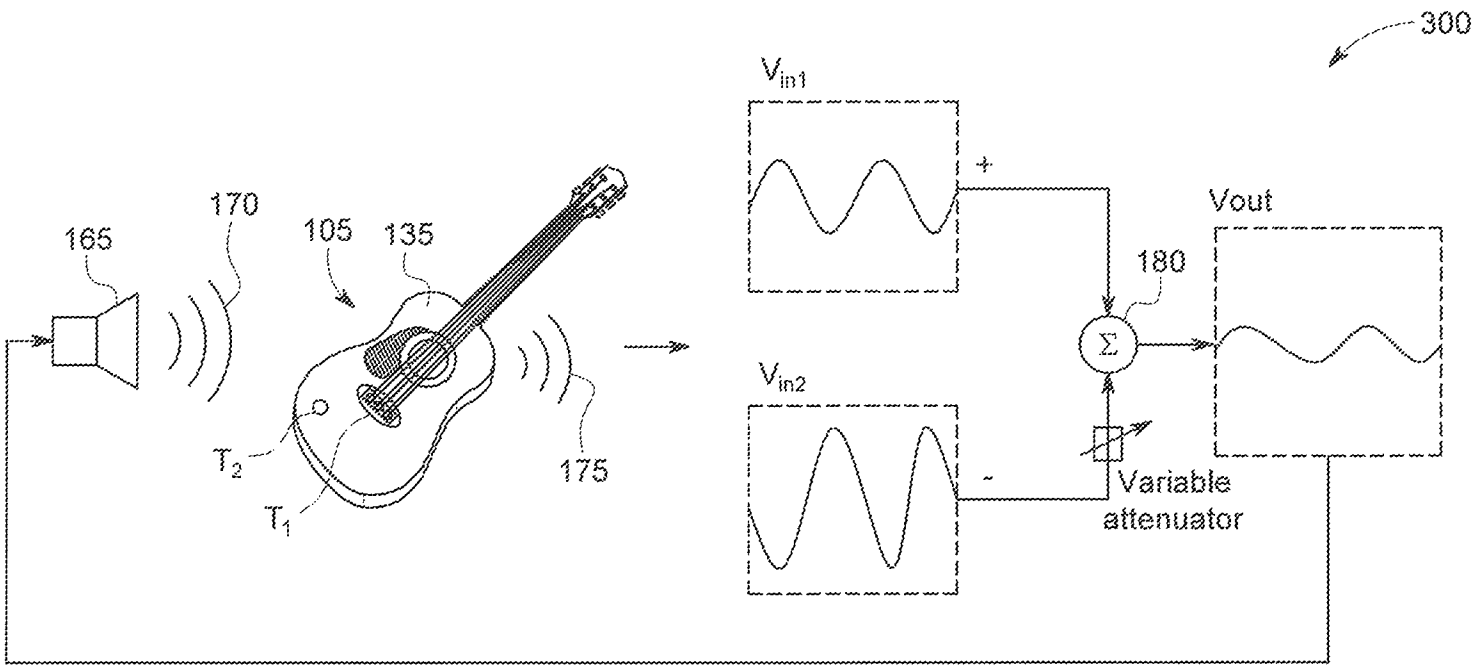
FIG. 3 depicts a diagrammatic view of an exemplary audio feedback scenario where a sound board vibration component of a first signal cancels out with a sound board vibration component of a second signal to produce a feedback-resistant output signal.

FIG. 3 depicts a diagrammatic view of an exemplary audio feedback scenario where a sound board vibration component of a first signal substantially attenuates or cancels out a sound board vibration component of a second signal to produce a feedback-resistant output signal. A feedback minimization cycle 300 is defined by the coupling between the instrument 105 and the speaker 165 via the sound board 135 and the transducers T1 (main) and T2 (feedback suppression). Specifically, the cycle 300 may start with a user plucking a string of the instrument 105. The string vibrates, exciting the natural resonant frequencies of the soundboard, which causes the transducers T1 and T2 to output respective signals VIN1 and VIN2 that have signal components representing both the string vibrations and the soundboard-related vibrations, in differing proportions, depending on the location of each transducer. For the sake of clarity and to demonstrate the concept, only the main resonance frequency of the soundboard is shown in the VIN1/VIN2 waveforms. The output of the transducers T1 and T2 is received by the circuit 180, which outputs an output signal VOUT destined for the amp 165.

The amp 165 amplifies VOUT and then produces a sound wave 170 associated both with the note of the plucked string and with the soundboard resonant frequencies. These resonant frequencies (dominant modes) may be determined by the materials, size, and shape of the instrument. The sound wave 170 impinges on the sound board 135 of the instrument 105, which results in sound board vibrations 175. The sound board 135 can be seen in this instance as a driven oscillator that is driven by the energy of the sound wave 170. This driving energy may most easily cause the sound board 135 to vibrate at its main resonant frequency, and these sound board vibrations 175 may be picked up by the transducers T1 and T2 and fed back into the amp 165. This feedback loop, in some circumstances, may create audio feedback that can quickly escalate to produce an unpleasantly loud sound from the amp 165. However, because (1) the transducers T1 and T2 may be out of phase, (2) a proportion of VIN2 may be selected by a variable attenuator VA to match (at the main resonant frequency (dominant mode)) the level of VIN1, and (3) circuitry including 180 cancels out at least a portion (e.g., most or all) of the sound board vibrations 175 in the output signal VOUT, then the system may advantageously minimize this feedback, thus resulting in the amp 165 outputting a high-quality tone associated with the vibrations of the plucked string without unwanted feedback due to sound board vibrations 175.

The cycle diagram 300 illustrates these concepts in a simplified schematic that is linked to the details depicted in FIG. 1. VIN1 may be the voltage source associated with a main transducer T1, while VIN2 may be the voltage source associated with a feedback suppression transducer T2. The respective waveforms associated with VIN1 and VIN2 are input into a summing junction 180, which may, for example, be part of the circuit 150 in FIG. 1. The summing junction 180, in some examples, sums the signals VIN1 and VIN2, thus substantially attenuating or cancelling out the sound board vibration components in each signal VIN1 and VIN2. The summing junction 180 then generates an output signal VOUT, which may have a waveform (e.g., 185 in FIG. 1) that is substantially lacking any substantial signal component associated with the sound board vibrations 175. The VOUT waveform may then be transmitted to the amp 165, where it is audibly output substantially without detrimental feedback that would otherwise tarnish the unique characteristic sound of the instrument 105.

Figure 4A:
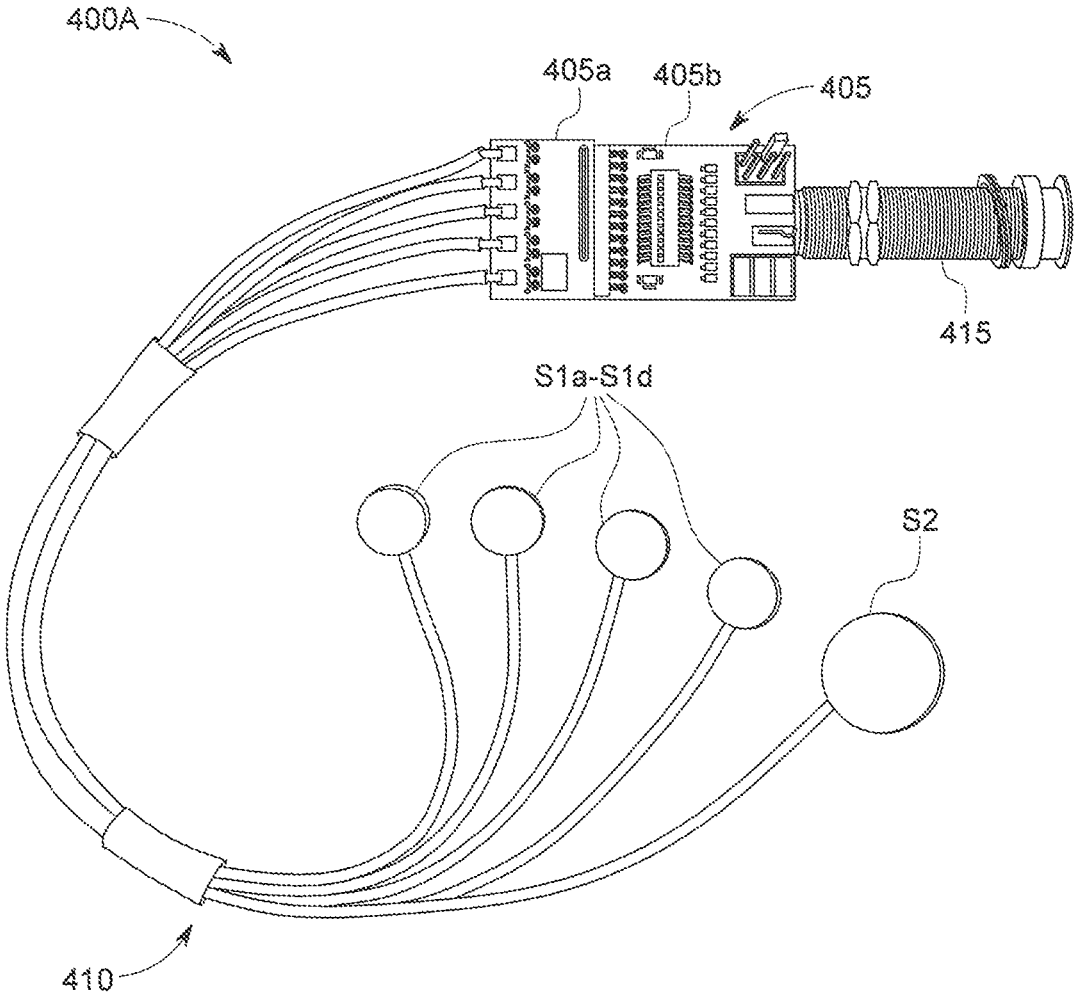
FIGS. 4A and 4B depict a top and a perspective view, respectively, of an exemplary feedback suppression printed circuit board (PCB) system.
Figure 4B:
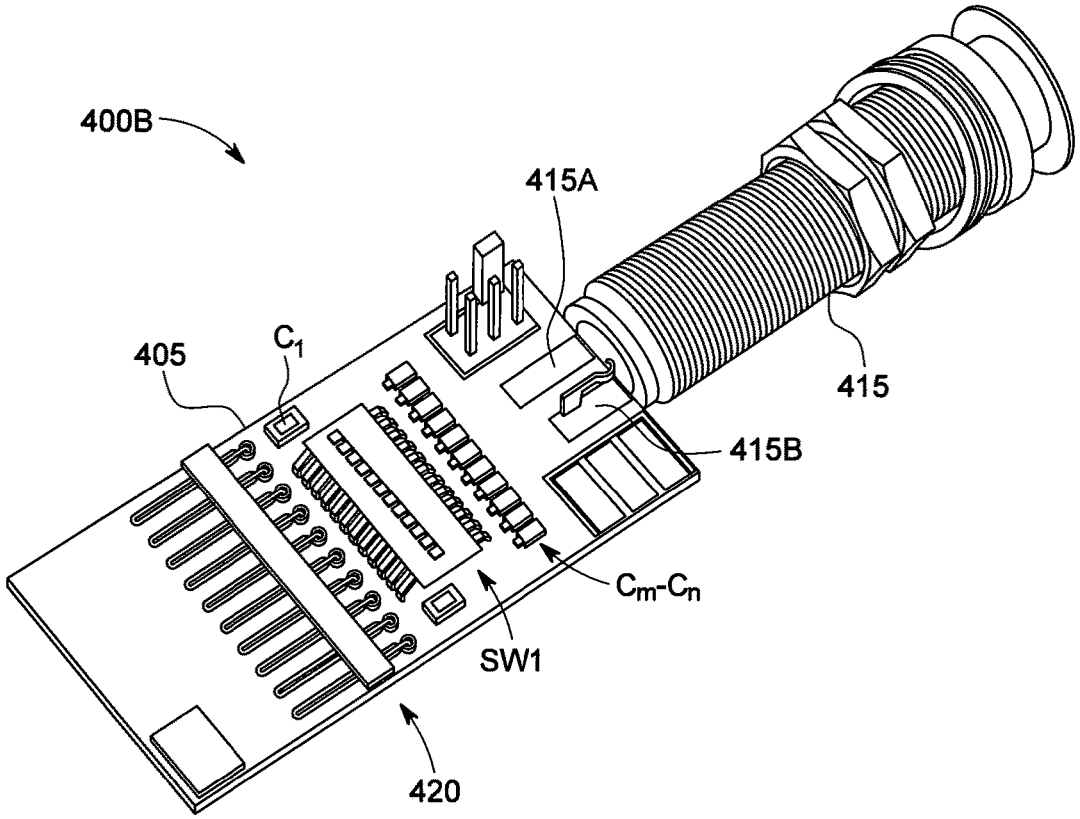

FIGS. 4A and 4B depict a top and perspective view, respectively, of an exemplary feedback suppression printed circuit board (PCB) system. An electrical system 400A shown in FIG. 4A includes four main piezoelectric sensors S1*a*, S1*b*, S1*c*, and S1*d*, and a feedback suppression piezoelectric sensor S2. Each sensor is electrically coupled with circuitry onboard a PCB 405 via wires 410. The PCB 405 is electrically coupled with an output connector 415 (e.g., a ¼" female jack) via leads 415A and 415B. In various examples, the system 400A may be installed in an acoustic instrument, which may convert the instrument from a purely acoustic instrument to an acoustic-electric instrument. The output connector 415 may operate as an output port for the instrument that allows the instrument to operatively couple with an amplifier or other audio electronics. In some examples, the PCB 405 may be two separate PCBs. For example, a daughter card PCB 405*a* may function to connect the electrical leads at the ends of the wires 410 to a main PCB 405*b*.

An electrical subsystem 400B includes a PCB 405 having inputs 420. In this example, the inputs 420 are prongs that electrically couple respective wires 410 associated with each sensor to the electronics onboard the PCB 405. The PCB 405 includes a capacitor C1. Capacitor C1 is electrically coupled to the outputs of the main sensors S1*a*-S1*d*. Capacitor C1 may serve to lower the effective capacitance of the main sensors S1*a*-S1*d* to a specific level suitable for mixing with the feedback sensor. The PCB 405 includes a capacitive network $C_m$-$C_n$. The PCB 405 includes a selector switch SW1 which may perform a selection function. In some examples, the capacitive network $C_m$-$C_n$ and the switch SW1 may be operatively coupled to the output of the feedback suppression sensor S2. The outputs of the sensors S1*a*-S1*d* and S2 may be capacitively coupled at a mutual output node, which may act as a summing junction for the signals received from the sensors S1*a*-S1*d* and S2.

The capacitive network $C_m$-$C_n$ may correspond to a choice of (m−n) different values (e.g., 11 values for $C_m$=C3 through $C_n$=C13 plus a $12^{th}$ value for an electrical short) selected by the switch SW1. The network $C_m$-$C_n$ along with the switch SW1 may allow for selection of one of (m−n) values to precisely adjust the signal level of the feedback sensor S2 that is mixed with the main sensor(s) S1*a*-S1*d* (or vice-versa). In an exemplary embodiment, the network and switch may allow for adjusting the signal level of the feedback sensor S2 in roughly 2 dB steps, although other step sizes may be contemplated (e.g., about 1 dB or about 1.5 dB). The capacitors on the PCB 305 may be similar to, analogous to, or the same as the two capacitors depicted in FIG. 5 (e.g., C1 may be equivalent to C1, and C2 may be equivalent to $C_m$-$C_n$).

Figure 5:
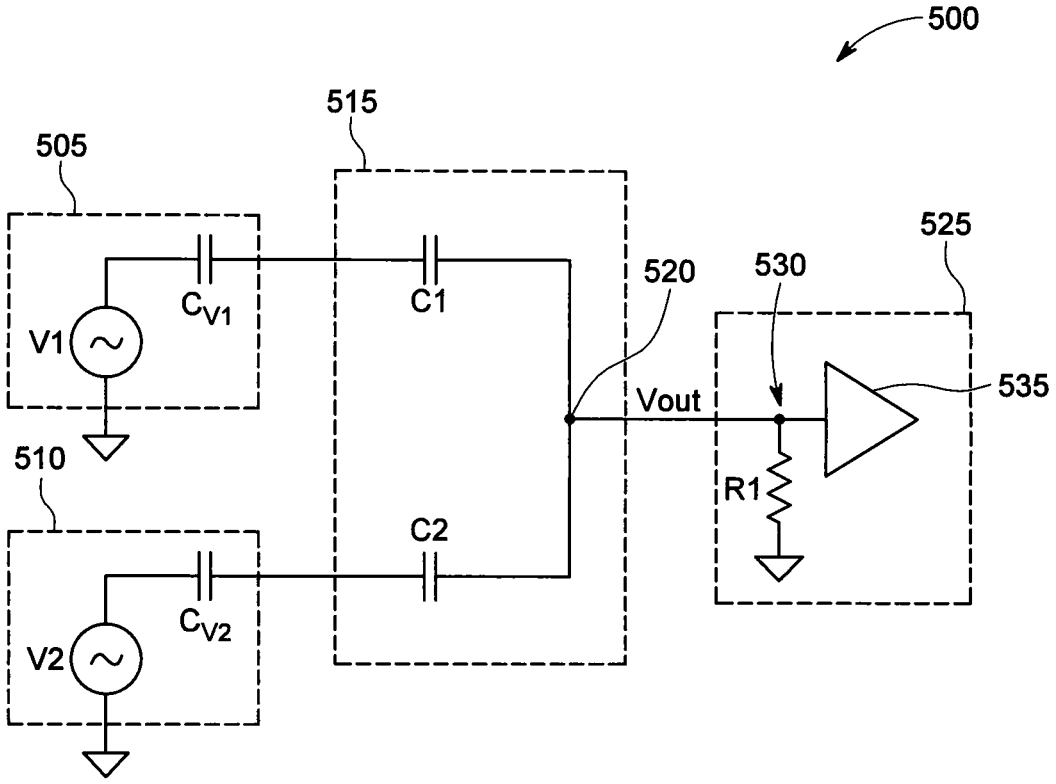
FIG. 5 depicts a diagrammatic view of an exemplary feedback suppression circuit system.

FIG. 5 depicts a diagrammatic view of an exemplary feedback suppression circuit system. The circuit system 500 may be an illustrative example of a circuit diagram of balancing circuit with pickup inputs and destination amplifier. The system 500 includes a main pickup sensor 505. The main sensor 505 may, in some examples, be an equivalent circuit representation of the sensors S1*a*-S1*b* depicted in FIGS. 1, 2A, and 2B shown with wire pigtails (e.g., 3 are shown in FIGS. 1, 2A, and 2B). For example, the sensors S1*a*-S1*b* may be connected in a parallel circuit configuration, thus forming a simplified equivalent electrical circuit illustrated by the block 505. The system 500 includes a feedback cancelling pickup sensor 510. The feedback cancelling sensor 510 may, in some examples, be an equivalent circuit representation of the sensor S2 depicted in FIGS. 1, 2A, and 2B shown with a wire pigtail. Each sensor 505, 510 is represented as a voltage source (V1, V2) with an effective capacitance ($C_{V1}$, $C_{V2}$).

The outputs of the sensors 505, 510 are received by a balancing circuit 515. The balancing circuit 515 includes a first balancing capacitor C1 having an input coupled in series with the output of the sensor 505, and a second balancing capacitor C2 having an input coupled in series with the output of the sensor 510. The outputs of the balancing capacitors C1 and C2 are mutually electrically coupled at a node 520, which may be included as part of the balancing circuit 515. The node 520 may be a summing/subtraction junction, in some examples, which may sum/subtract the signals received from the outputs of the capacitors C1 and C2. The node 520 is further electrically coupled to an electrical output that delivers a summed/subtracted signal as voltage output signal VOUT. The output of the balancing circuit 515 may terminate in a jack or wire, for example, that may plug into an amplifier circuit 525.

Various examples may include at least three parts: a main pickup 505, a feedback cancelling pickup 510, and a balancing circuit 515. The main pickup 505 may include multiple piezoelectric (disc) sensors, for example. The piezoelectric disc sensors may be fixedly coupled (e.g., taped or glued) to the bridge plate, right below the spot where the saddle rests upon the top side of the sound board. These multiple piezo sensors may be wired in parallel to form one electrical entity (e.g., the main pickup 505). This entity may transduce the sound of the strings and sound board modes in approximately equal measure, for example.

The feedback cancelling pickup 510 may include at least one piezoelectric sensor, located in a distinctly different position than the main pickup sensor 505, for example (see, e.g., the positions of S2 in FIGS. 2A and 2B). The feedback cancelling pickup 510 may transduce the sound of the strings and sound board modes, but in a proportion different to that of the main pickup 505. The ratio of sound board vibration energy/amplitude to string vibration energy/amplitude may be higher in this distinctly different position due to the extra distance to position where the highest string energy may be detected (e.g., at, under, or near the saddle). In some examples, the position of the main pickup 505 and the feedback cancelling pickup 510 may sense approximately equal amounts of the sound board modes (e.g., differing by no more than about 0.1%, 0.5%, 1%, 2%, 5%, 10%, 15%, or about 20% or more). In various embodiments, the feedback cancelling pickup 510 may sense, for example, as much as 20 dB more sound board modes signal than the main pickup 505. Both cases may be accommodated by proper selection of mix proportion as described with reference to FIGS. 4A and 4B.

Piezoelectric sensors may have one of two possible polarities (positive or negative), depending on the orientation of the polarization of the crystal structure, for example. In some embodiments, the multiple sensor elements of the main pickup 505 may be configured to all have the same (e.g., positive) polarity. The feedback cancelling pickup 510 may, in some examples, be configured to have a polarity opposite to that of main pickup (which may be a negative polarity, for example). This opposite polarity may be achieved, for example, through specification (e.g., how the disc manufacturer polarizes the crystal), or by attaching the wire pigtail with reversed connections to a sensor with opposite (positive) polarity.

The balancing circuit 515 may include a capacitor C1 and capacitor C2. The balancing circuit may accept two inputs: (1) one (combined) input for each from the main pickups with equivalent circuit 505 including a voltage source node V1 and series capacitor $C_{V1}$, and (2) one input from the feedback cancelling pickup with equivalent circuit 510 including a voltage source node V2 and series capacitor $C_{V2}$. The balancing circuit 515 may combine the two signal sources together to feed the node 520 resulting in output signal VOUT coupled with impedance R1 connected to external amplifier 535 at node 530.

Various implementations of the circuit 500 may achieve the advantage of minimizing the level of a dominant mode of the sound board that is output electrically (e.g., when the sound board is physically stimulated by vibrations of the strings). Such stimulation may represent what happens when the instrument feeds back in response to amplification by a loudspeaker (e.g., amp 160, FIG. 1) in proximity to the instrument. Since the main pickup 505 and the feedback cancelling pickup 510 may be out of phase with each other, for example, combining the signals from the pickups 505, 510 may cause some cancellation of signals that are common to both, assuming the signals have a similar phase relationship to each other (e.g., in the range of about 0° to about 45° phase relationship).

To get the most cancelation of the dominant mode vibrations generated by the sound board, the exact proportion of each signal input in the balancing circuit 515 may be proportional to the strength of the dominant mode that each sensor/pickup 505, 510 is transducing. From an analysis of the circuit 500, it can be shown that the signal appearing at node 530 may be represented as a mix or superposition of V1 and V2, the proportion of which depends on the values of the capacitors $C_{V1}$, $C_{V2}$, C1, and C2. Assuming R1 is sufficiently high as to not load the circuit appreciably, then the equation representing this circuit response may be:

$$Vout = \frac{V1 * par(CV1, C1) + V2 * par(CV2, C2)}{par(CV1, C1) + par(CV2, C2)}$$

Where two capacitors in series equals the parallel combination of their values defined by the following formula:

$$par(x, y) = \frac{(x * y)}{(x + y)}$$

The amount of resistance for R1 to be "sufficiently high" to not load the circuit "appreciably" may be in the vicinity of about 50, 100, 150, or about 200 KΩ or more, for example. In an illustrative example, the resistance of R1 may be about 1 MΩ, the capacitance of CV1 may be about 25 nF to about 40 nF, the capacitance of Cv2 may be about 9 nF to about 18 nF, the capacitance of C1 may be about 22 nF, and the capacitance of C2 may be variable, in fixed steps, and/or set by a user/manufacturer.

In various embodiments, the intrinsic capacitance values $C_{V1}$ and $C_{V2}$ may be determined by the physical construction, constituent material, or other attributes of the specific piezoelectric sensor being used. $C_{V1}$ may represent the parallel combination of the intrinsic capacitances of the sensor(s) that make up the main pickup 505. Similarly, $C_{V2}$ may represent the intrinsic capacitance of the sensor(s) that make up the feedback cancelation sensor 510. These capacitance values may be fixed and controlled by specification. It can be seen that values for capacitors C1 and C2 can be chosen to allow any desired combination proportion of signals V1 and V2. Hence, by the selection of two capacitor values C1 and C2, the balancing circuit 515 may allow a user to adjust the proportion of signals between the two pickups as received at the node 520, so as to achieve maximum cancellation of the dominant mode of the sound board.

In a preferred embodiment, one or the other of either capacitor C1 or C2 may be fixed in advance. A user may select and appropriate value for the other capacitor based on a characteristic measured response of the acoustic instrument. This measurement may be be by ear, or with the help of electronics instruments such as a voltmeter or a spectrum analyzer, for example. The dominant mode of the instrument can be excited be vibrating the sound board with an electrodynamic exciter or actuator that is connected to an audio generator, for example. The exciter may be connected to a network analyzer, in some embodiments. In a preferred embodiment, the balancing circuit may be fitted with a multiple position switch for C1 and/or C2, with each switch position contact connected to a different value of capacitor (see, e.g., SW1 and $C_m$-$C_n$ shown in FIG. 4B). In this way, a user can conveniently select a distinct position of the switch to affect a change in capacitor value with predetermined V2 attenuation steps (e.g., in decibels, such as about 2 dB).

In some embodiments, various pickups/sensors may be mounted directly on the sound board (top plate) of the instrument (e.g., either the top side or bottom side). Similar results may be achieved if the location of the feedback cancelling pickup 510 is some distance from the main pickup 505, and detects a similar level of top plate resonance in response to external (non-string) stimulus. In various examples, the signals from the main pickup and the feedback cancelling pickup may be brought out of the guitar as two separate signals, which may then be combined externally with an external balancing circuit or with an external audio mixer, for example, to achieve the desired feedback cancelling operation. Various embodiments may employ an active (summer) mixer, which may, for example, be put on the sound board of the instrument. Some examples may employ a passive capacitive mixer that does not require a power source such as a battery for operation. An on-board switch may be mounted to the instrument (perhaps with accessibility through the sound hole, or externally), so that a user may switch off the connection to the feedback cancelling pickup at will. In this way, the instrument may have at least two modes of operation: (1) "traditional mode" for low level situations where feedback is not a concern, and (2) "feedback suppression mode" for much higher levels of feedback immunity, in situations where high feedback levels would be encountered.

Figure 6A:
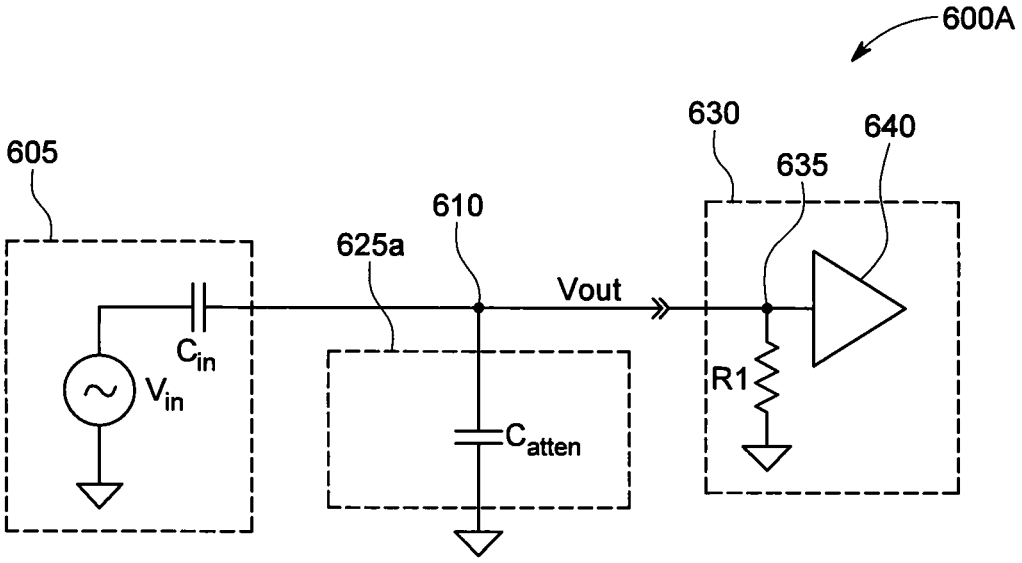
FIGS. 6A and 6B depict diagrammatic views of exemplary passive attenuator circuits.
Figure 6B:
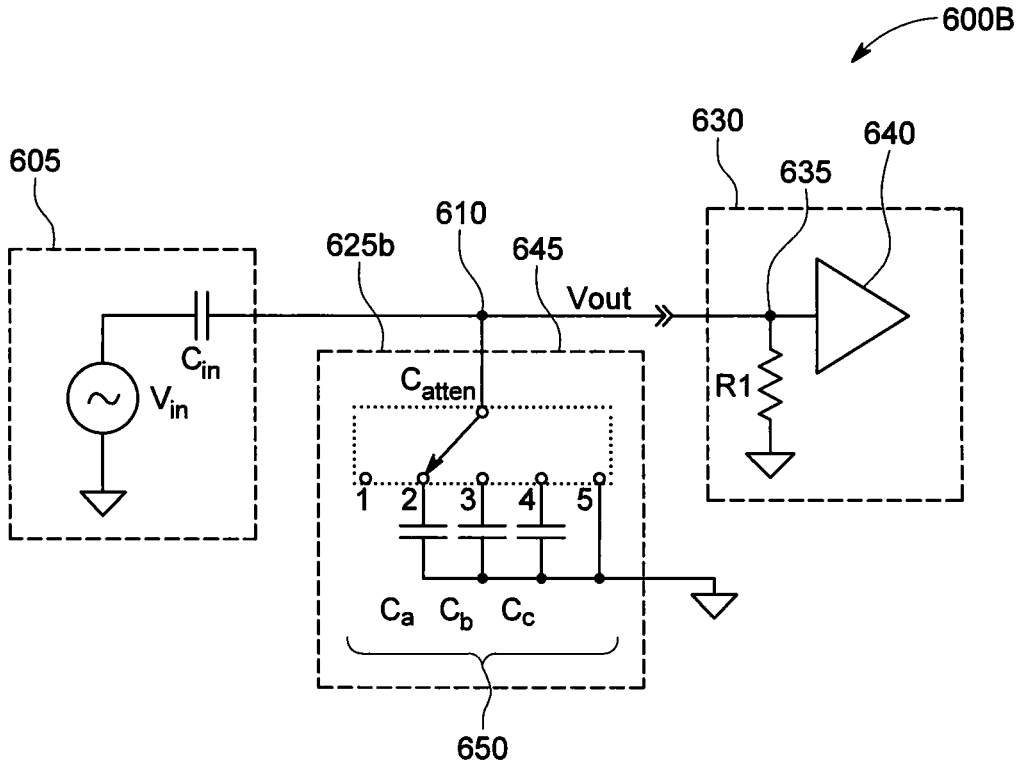

FIGS. 6A and 6B depict diagrammatic views of exemplary passive attenuator circuits. FIG. 6A depicts an equivalent circuit of a pickup, an attenuator, and a connection to an amplifier, while FIG. 6B depicts an equivalent circuit of a pickup, a multiple position attenuator, and a connection to an amplifier. An advantage of the passive attenuator circuits shown in FIGS. 6A and 6B may be that they provide a convenient and passive apparatus of attenuating an output signal Vout. A passive electronic apparatus may be highly desirable because active circuitry requires power and that necessitates the use of a potentially bulky battery for portable applications. The attenuator circuits may possess the advantages of: passive implementation requiring no active circuitry or battery; utilizes low cost, commonly available components; maintains the low impedance nature of the piezoelectric transducers; does not interfere with the desired frequency response; and exploits the nature of piezo transducers (voltage source in series with a capacitor).

A circuit system 600A depicted in FIG. 6A includes a piezoelectric transducer equivalent circuit 605 that includes a transducer voltage source Vin and an intrinsic capacitance Cin. An output of the transducer 605 is electrically coupled to a node 610. Electrically coupled to the node 610 is an attenuator 625*a*, which includes an attenuator capacitor Catten configured to attenuate signals output by the transducer 605. The circuit system 600A includes an external preamplifier 630 that includes a preamplifier input impedance resistor R1 and an active gain section 640. The output of the node 610 is electrically coupled to another node 635, which is electrically coupled to both the resistor R1 and the active gain section 640. The electrical couplings of the circuit system 600A allow for an attenuated output signal Vout to be received by the external preamplifier 630.

A circuit system 600B depicted in FIG. 6B includes many of the same parts and couplings as detailed in the circuit system 600A. However, the attenuator 625*a* has been replaced with a multiple position attenuator 625*b* that is configured to control a level of attenuation of the attenuated output signal Vout received by the external preamplifier 630. The multiple position attenuator 625*b* includes a selector switch 645 and at least two capacitors Ca, Cb, and Cc (collectively referred to as attenuator capacitors 650).

The components in the systems 600A and 600B may connect in the following manner, in an illustrative example. The piezoelectric transducer 605 may connect to an external amplifier or preamplifier 630 via its output signal Vout. The transducer 605 and the amp 630 may share a common ground. Attenuator 625*a* or 625*b* may be connected to the Vout signal and to ground.

The components in the systems 600A and 600B may operate according to the following principles of operation, for example. At audio frequencies, a piezoelectric transducer 605 can be represented as a voltage source Vin in series with an intrinsic capacitance Cin. This capacitance Cin may appear in series with the voltage source. This may be true whether the transducer is a single sensor, or multiple sensors connected together (e.g., in parallel). In either case, the equivalent circuit 605 reduces to a single voltage source and a single output capacitance in series with the voltage source as shown. The transducer 605 may be in electrical communication with an external amplifier or preamplifier 630 with input impedance R1 and active amplification circuit 640. In various embodiments, R1 may be large enough so as to not affect the frequency response in the frequency band of interest. R1 may, for example, be about 100 kΩ or more, such as about 1 MΩ. Cin may, for example, be about 2, 5, 10, 20, or about 50 nF or more. These values for R1 and Cin may place the low frequency roll-off point at about 16 Hz or lower (e.g., with Cin=10 nF and R1=1MΩ).

As shown in FIG. 6A, attenuator 625*a* includes a capacitor Catten connected between Vout and ground. It can be mathematically shown that this forms a voltage divider with Cin such that:

$$Vout = \frac{Vin * Cin}{Cin + Catten}$$

Thus, the larger the value of Catten, the more attenuation may be imparted to Vout. It can also be shown that the low frequency roll-off point becomes:

$$\frac{1}{2 * \pi * R1 * (Cin + Catten)}$$

The above equation indicates that the roll-off frequency gets lower with more attenuation (e.g., with a higher value of Catten). Since it is already lower than the band of interest (e.g., about 16 Hz), the attenuation may cause no ill effect on the frequency output of the attenuator circuits 600A, 600B.

The attenuator circuit 600B may beneficially provide a convenient method to adjust or vary the amount of attenuation applied to Vout. The attenuator circuit 600B may provide an adjustable attenuator 625*b* that includes a multi-position (e.g., 5-position) selector switch 645 connected to load capacitors 650 and to ground. Note that position 1 in this exemplary depiction, is unconnected to ground, which would provide no attenuation to the output signal Vout. Position 5 in this exemplary depiction is connected straight to ground, which would provide total or absolute attenuation and make Vout=0. The middle positions 2, 3, and 4 shown in this exemplary depiction are connected to different capacitor values Ca, Cb, and Cc that may provide whatever attenuation levels are appropriate for a given situation. An exemplary embodiment would have 5 positions as: 1.=no attenuation; 2.=low attenuation; 3.=medium low attenuation; 4.=medium high attenuation; 5.=off. However, this example is merely illustrative and is not intended to be limiting. The exact positions need not conform to any ordering, may be selected at will, and may be independent of each other.

In various examples, the attenuator could be a single on/off switch for one level of attenuation or none. A multiple positions selector switch may be a slide switch with linear travel, may travel along an arc to make the action curved (e.g., concave or convex), or may be a rotary control (e.g., like a potentiometer), but with multiple contacts instead of a variable resistance, for example. In some embodiments, a true continuously variable capacitance structure could be devised/implemented. Some applications may be onboard an acoustic instrument (e.g., such as a guitar fitted with one or more piezo transducer pickups). Some implementations could be used anywhere a piezoelectric transducer's output level needs to be adjusted. For example, in systems with multiple sensors, each transducer could have an adjustment capacitor that would tweak the attenuation to a pre-specified level. In this way, all the sensors in the system may be made to have the same or predetermined output levels in response to calibration signals, for example.

Figure 7:
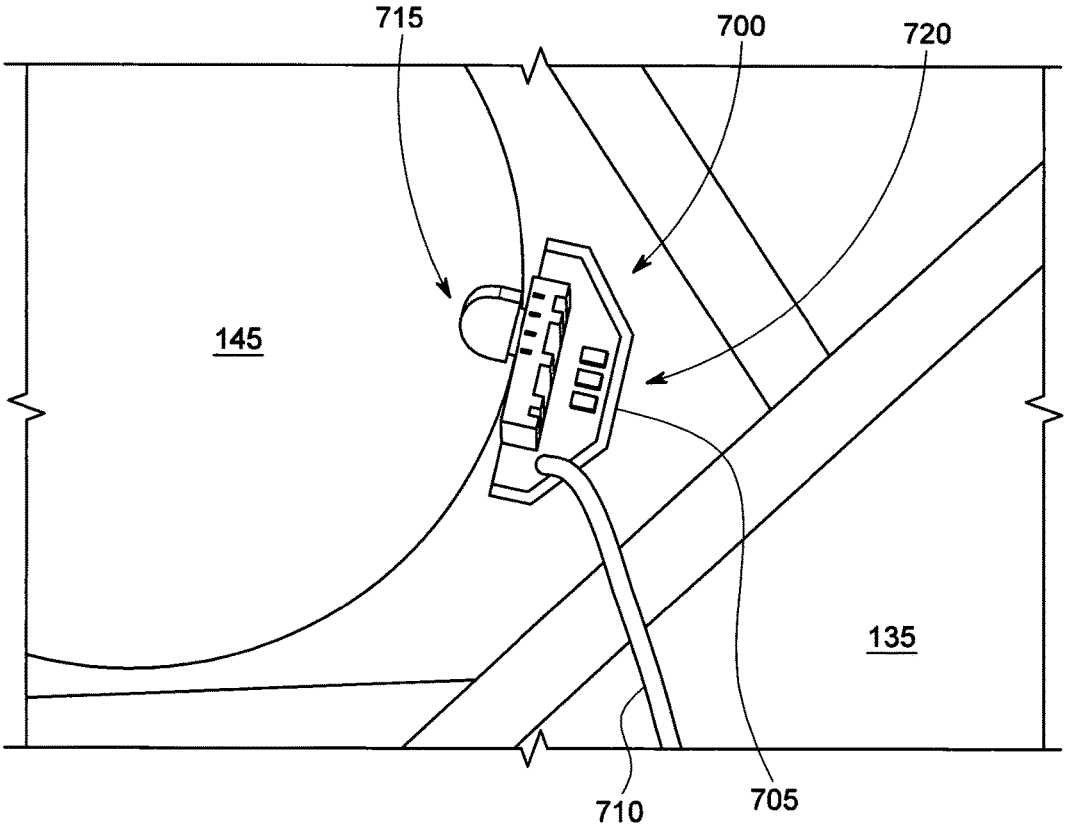
FIG. 7 depicts a perspective view of an exemplary variable attenuator in the form of a circuit board.

FIG. 7 depicts a perspective view of an exemplary variable attenuator in the form of a circuit board. A variable attenuator 700 may be fixedly coupled (e.g., via glue or tape) to the inside of an instrument's sound board 135 proximate to the instrument's sound hole 145. The variable attenuator 700 may be implemented using an attenuator PCB 705. The PCB 705 may be electrically coupled to a wire 710, which in turn may be electrically coupled with an acoustic transducer (not shown). The variable attenuator 700 may include a user-adjustable switch 715 (e.g., a four-positions slide switch as shown). The variable attenuator 700 may include capacitor(s) 720 operatively coupled to the switch 715. The capacitor(s) 720 in cooperation with the switch may provide for different levels of signal attenuation. For example, in the depicted embodiment, the switch and capacitors may provide for the following settings: off (short), low (larger C), medium (smaller C), and high (full volume, open, no C).

In various examples, various aspects of the passive attenuator exemplified in FIGS. 6A and 6B may be combined or mixed with various aspects of the feedback suppression circuit exemplified in FIG. 5. For example, the Vin/Cin block 605 may be an equivalent circuit to the combined V1/CV1 and V2/CV2 blocks 505, 510. Furthermore, in some embodiments, block 515 (including C1 and C2 and node 520) may be included in the block 605 as well. In various examples, the node 610 for coupling the attenuator blocks 625*a* or 625*b* may be electrically coupled between the nodes 520 and 530. In some implementations, Vin and Cin may represent a distillation of blocks 505, 510, and 515 all rolled up into an equivalent circuit for the purposes of being the source that drives attenuator blocks 625*a* or 625*b*. In various applications, either of the attenuator blocks 625*a* or 625*b* may connect to node 530 to couple with Vout. The node 530 may be the point that the attenuator uses to shunt a transduced signal to ground via its own variable/selectable capacitance.

Although various embodiments have been described with reference to the Figures, other embodiments are possible. For example, an instrument may be an acoustic guitar. An acoustic guitar may include a sound board, a sound hole, a bridge plate, and reinforcement braces and/or struts. These parts may be configured as part of an entire acoustic guitar system complete with strings resting on a saddle and bridge, which may form a complex resonant chamber that both amplifies and gives richness to the vibrations of the strings.

Various examples may employ a variable capacitor (e.g., a varicap diode, varactor diode, variable capacitance diode, variable reactance diode or tuning diode), which may be a type of diode designed to exploit the voltage-dependent capacitance of a reversed-biased p-n junction. For example, the capacitors C1, C2, and/or Catten may each be a variable capacitor, and/or the capacitors (Ca, Cb and Cc) or ($C_m$-$C_n$) may each be a single variable capacitor. Some embodiments may employ a microprocessor to tune a variable capacitor to optimize the amount of capacitive coupling between a first acoustic transducer and a second acoustic transducer. Various embodiments may directly capacitively couple a first signal from a main sensor with a second signal from a feedback suppression sensor (e.g., without amplification and/or gain). Although some examples may refer to specific types of acoustic sensors (e.g., piezoelectric discs), other types of acoustic sensors may be used.

In various examples, an external acoustic energy signature of a first signal (e.g., V1) may be equal in amplitude but 180° out of phase with an external acoustic energy signature of a second signal (e.g., V2). In response to external acoustic energy, the main and feedback suppression sensors may produce substantially similar signals that are 180° out of phase. A main sensor may be physically mounted in an opposite orientation (e.g., upside down) relative to a feedback suppression sensor, such that the response of the sensors to external acoustic energy is substantially 180° out of phase. In various examples, the signals from the main and feedback suppression acoustic sensors may be in phase with one another, but an intermediate circuit component (e.g., an inverter) may alter the phase of one of the signals from one of the sensors to achieve cancellation of sound board vibration signatures of the two sensor signals.

In an illustrative example, an acoustic-electric sensor system may include an acoustic-electric stringed instrument. The acoustic-electric stringed instrument may include a sound board, a saddle, and a sound board string coupling point configured to mechanically couple at least one string to the sound board, for example. The system may include a main acoustic sensor operably coupled to detect vibrations of the strings of the acoustic-electric stringed instrument. The system may include a feedback suppression acoustic sensor operably coupled to detect vibrations of the sound board. The feedback suppression acoustic sensor may be spaced outside of an ellipse substantially centered around the saddle, for example. The system may include a mixing module configured to receive a first output signal from the main acoustic sensor and a second output signal from the feedback suppression acoustic sensor. The mixing module may be configured to output a mixed output signal that is a function of the first output signal and the second output signal, such that a second sound board vibration signature of the second output signal at least partially cancels out with a first sound board vibration signature of the first output signal to produce the mixed output signal that is resistant to audio feedback.

In some implementations, the main acoustic sensor may be arranged in at least one of a Undersaddle Sensor (UST), a Soundboard Sensor (SBT), or Bridge Plate Pickup configuration. In various examples, the ellipse may be a circle. The ellipse may have a major axis of length 3" and a minor axis of length 1", for example. The ellipse may be sized to enclose a bridge of the acoustic-electric stringed instrument.

In various embodiments, the main acoustic sensor and the feedback suppression acoustic sensor may include respective piezoelectric acoustic transducers. Some implementations of the system may have the feedback suppression acoustic sensor spaced sufficiently apart from the main acoustic sensor and sufficiently remote from the sound board string coupling point, such that the feedback suppression acoustic sensor may be configured to primarily detect vibrations of the sound board while substantially avoiding vibrations of strings of the acoustic-electric stringed instrument at the saddle.

In some examples, the feedback suppression acoustic sensor may be in an 180° out-of-phase relationship with the main acoustic sensor, with respect to sound board modes In various examples, the feedback suppression sensor may have the same polarity as the main sensor, but be mounted in an optimal location where the sound board modes manifest in an 180° out-of-phase relationship relative to the main sensor(s), due to the physical structure of the instrument. In various examples, the mixing module may include a summing junction configured to sum the first and second output signals to produce the mixed output signal that includes a superposition of the first and second output signals. In some implementations, the mixing module may include an adjustable attenuator including a multi-position selector switch configured to selectively couple the second output signal to one of a plurality of load capacitors.

An exemplary embodiment may include an array of piezoelectric sensors including one or more main sensor(s) and one or more feedback suppression sensor(s), where the main sensor(s) are installed in an acoustic-electric stringed instrument in either an Undersaddle Transducer (UST) or Soundboard Transducer (SBT) configuration and the feedback suppression sensor(s) are substantially responsive to vibrations of a sound board of the instrument and placed at a location on the sound board outside of an ellipse centered on a bridge/saddle of the instrument and having a predetermined major and minor axis, where an output of a circuit combines the signals from the main sensor(s) and the feedback suppression sensor(s), such that the top vibrations detected by the feedback suppression sensor(s) cancel out the top vibrations detected by the main sensor(s) to produce the output of the circuit that is resistant to feedback and retains the unique characteristic sound of the instrument.

An exemplary embodiment may include an array of piezoelectric sensors including one or more main sensor(s) and one or more feedback suppression sensor(s), where the main sensor(s) are installed in an acoustic-electric stringed instrument in either an Undersaddle Transducer (UST) or Soundboard Transducer (SBT) configuration, while the feedback suppression sensor(s) are spaced sufficiently apart from the main sensor(s) and remote from the string anchor points of the instrument, such that the feedback suppression sensor(s) are configured to primarily detect top vibrations of the acoustic-electric stringed instrument while detecting a substantially attenuated vibrational signal of the strings of the instrument, where an output of a circuit combines the signals from the main sensor(s) and the feedback suppression sensor(s), such that the top vibrations detected by the feedback suppression sensor(s) cancel out the top vibrations detected by the main sensor(s) to produce the output of the circuit that is resistant to feedback and retains the unique characteristic sound of the instrument.

A piezoelectric sensor system may include, for example at least one feedback suppression sensor that is strategically placed to detect top vibrations of an acoustic-electric stringed instrument (e.g., an acoustic-electric guitar) that is in a 180° out-of-phase relationship with at least one main sensor oriented in either an Undersaddle Transducer (UST) or Soundboard Transducer (SBT) configuration. The feedback suppression sensor may be sufficiently remote from the saddle and/or string anchor points of the guitar, so that the feedback suppression sensor strongly detects mechanical vibrations of a top surface of the guitar while substantially avoiding detection of the string vibrations of the strings of the guitar. For example, the feedback suppression sensor may be placed outside of a circle (or ellipse) having a predetermined radius (or major/minor axis) that encloses the bridge/saddle of the guitar.

In an exemplary implementation, the feedback suppression sensor and the main sensor may be capacitively coupled to one another in a summing circuit. Because both sensors may detect similar vibrational information, but may be 180° out-of-phase with one another (flipped-polarity), the summing circuit may cancel out similar information detected by both sensors. The string vibration information detected by the main sensor may be only weakly detected by the feedback suppression sensor. Therefore, the summed signals from both sensors may produce an output signal (Vout) having the top vibrations of the guitar cancelled out, while still preserving the string vibrations detected by the main sensor. In this sense, the circuit may take advantage of principle of cancellation (to minimize feedback) while retaining the characteristic sound of the strings and the guitar. The signal may be achieved by the amplitude/power of the string vibrations detected by the main sensor (Rmain) and the amplitude/power of the string vibrations detected by the feedback suppression sensor (Ribs) having a relative ratio of 6 dB or more.

In an illustrative embodiment, an array of piezoelectric sensors may include one or more main sensor(s) and one or more feedback suppression sensor(s). The main sensor(s) may be installed in an acoustic-electric stringed instrument in either an Undersaddle Transducer (UST) or Soundboard Transducer (SBT) configuration. The feedback suppression sensor(s) may be spaced sufficiently apart from the main sensor(s) and remote from the strings of the acoustic-electric stringed instrument, such that the feedback suppression sensor(s) are configured to primarily detect top vibrations of the acoustic-electric stringed instrument while substantially avoiding vibrational energy of the strings of the acoustic-electric stringed instrument. The feedback suppression sensor(s) may be in an 180° out-of-phase relationship with the main sensor(s). An output of a circuit may be the sum of the signals from the main sensor(s) and the feedback suppression sensor(s), such that the top vibrations detected by the feedback suppression sensor(s) may cancel out the top vibrations detected by the main sensor(s) to produce the output of the circuit that may be resistant to feedback and retains the unique characteristic sound of the acoustic-electric stringed instrument. In some embodiments, a circuit may include a switched capacitor for a capacitive divider. The circuit may employ a multiplexing function to select different capacitors.

In various examples, an acoustic-electric sensor system may include an acoustic-electric stringed instrument. The acoustic-electric stringed instrument may include a sound board configured to vibrate in response to incident external acoustic energy, a saddle to support the strings of the instrument, and a sound board string coupling point configured to mechanically couple at least one string to the sound board. The system may include a main acoustic sensor operably coupled to the acoustic-electric stringed instrument and configured to output a main signal. The main signal may include a first signal component that represents string vibrations of the acoustic-electric stringed instrument, and a second signal component that represents sound board vibrations of the acoustic-electric stringed instrument. The system may include a feedback suppression acoustic sensor operably coupled to the acoustic-electric stringed instrument and configured to output a feedback suppression signal. The feedback suppression signal may include a third signal component that represents sound board vibrations of the acoustic-electric stringed instrument. The system may include a mixing circuit operably coupled to an output of the main acoustic sensor and an output of the feedback suppression acoustic sensor. The mixing circuit may be configured to couple the main signal with the feedback suppression signal to generate a mixed output signal. The second signal component may at least partially cancel out with the third signal component in the mixed output signal to substantially attenuate the second signal component in the mixed output signal.

In various examples, the main acoustic sensor may be arranged in at least one of a Undersaddle Sensor (UST), a Soundboard Sensor (SBT), or Bridge Plate Pickup configuration. The feedback suppression acoustic sensor may be located, in some embodiments, outside of an ellipse that: (1) is substantially centered at the saddle, (2) extends in a plane that is substantially parallel to a sound board plane defined by the sound board, and (3) has a major and minor axis having respective lengths of at least 0.5 inches. The ellipse may have a major axis at least 2.5 inches in length and a minor axis at least 1 inch in length. The ellipse may be sized to completely enclose a bridge of the acoustic-electric stringed instrument.

In various examples, the feedback suppression acoustic sensor may be located sufficiently apart from the main acoustic sensor and sufficiently remote from the sound board string coupling point such that the feedback suppression acoustic sensor may be configured to primarily detect sound board vibrations of the acoustic-electric stringed instrument while substantially avoiding string vibrations of the acoustic-electric stringed instrument at the sound board string coupling point. The feedback suppression acoustic sensor may be, for example, configured to detect string vibrations of the acoustic-electric stringed instrument at amplitude $FB_{str}$, while the main acoustic sensor may, for example, be configured to detect string vibrations of the acoustic-electric stringed instrument at amplitude $MN_{str}$, where the ratio of $MN_{str}$ to $FB_{str}$ may be about 3, 4, 5, or about 6 dB or more. The ratio of $MN_{str}$ to FBstr may be a ratio of the string vibration amplitude of the main sensor relative to the string vibration amplitude of the feedback suppression sensor. In an exemplary embodiment, the ratio of the sound board vibration signatures between the main sensor and the feedback suppression sensor may be about unity (e.g., pure cancellation of the sound board vibration signature in the mixed output signal). In an exemplary implementation, the ratio of the string vibration signatures between the two sensors may be greater than unity (e.g., the amplitude of string vibrations detected by main sensor may be greater than amplitude of string vibrations detected by feedback suppression sensor). For example, an amplitude ratio of main sensor to suppression sensor may be greater than about 6 dB (e.g., about 10 dB) for string vibrations, while an amplitude ratio of main sensor to suppression sensor may be in the range of about 0 dB to about −20 dB for sound board resonance vibrations. Put another way, the suppression sensor may, for example, be up to about 20 dB louder than the main sensor with respect to a sound board vibration component, and may, for example, be at least about 6 dB quieter with respect to string vibrations.

In some examples, the main acoustic sensor and the feedback suppression acoustic sensor may be respective piezoelectric acoustic transducers. The feedback suppression acoustic sensor may be configured in a 180° out-of-phase relationship with the main acoustic sensor. The feedback suppression acoustic sensor and the main acoustic sensor may be mechanically coupled to the acoustic-electric stringed instrument, such that the feedback suppression sensor may be oriented in an opposite polarity configuration with respect to the main acoustic sensor. The capacitive mixing circuit may, in some embodiments, include a variable capacitor configured to selectively adjust a level of capacitive coupling between the main signal with the feedback suppression signal.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments may be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random-access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from a source to a receiver over a dedicated physical link (e.g., fiber optic link, infrared link, ultrasonic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, FireWire, ATA/IDE, RS-232, RS-422, RS-485, 802.11 a/b/g/n, Wi-Fi, WiFi-Direct, Li-Fi, BlueTooth, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

In various embodiments, a computer system may include non-transitory memory. The memory may be connected to the one or more processors may be configured for encoding data and computer readable instructions, including processor executable program instructions. The data and computer readable instructions may be accessible to the one or more processors. The processor executable program instructions, when executed by the one or more processors, may cause the one or more processors to perform various operations.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An acoustic-electric sensor system comprising:

an acoustic-electric stringed instrument comprising:

a sound board configured to vibrate in response to incident external acoustic energy; and, a saddle configured to vibrationally couple with at least one string of the acoustic-electric stringed instrument;

a main acoustic sensor operably coupled to the acoustic-electric stringed instrument and configured to output a main signal that comprises:

a first signal component that represents string vibrations of the acoustic-electric stringed instrument; and, a second signal component that represents sound board vibrations of the acoustic-electric stringed instrument;

a feedback suppression acoustic sensor operably coupled to the acoustic-electric stringed instrument and configured to output a feedback suppression signal that comprises a third signal component that represents sound board vibrations of the acoustic-electric stringed instrument; and, a mixing module configured to receive the main signal and the feedback suppression signal, and configured to mix the main signal with the feedback suppression signal to generate a mixed output signal, wherein when the mixed output signal is generated, the second signal component at least partially cancels out with the third signal component in the mixed output signal to substantially attenuate the second signal component in the mixed output signal.

2. The acoustic-electric sensor system of claim 1, wherein the feedback suppression acoustic sensor is disposed outside of an ellipse that: (1) is substantially centered at the saddle, (2) extends in a plane that is substantially parallel to a sound board plane defined by the sound board, (3) comprises a major and a minor axis, and (4) encloses the saddle.

3. The acoustic-electric sensor system of claim 2, wherein the major axis of the ellipse is at least 3 inches in length and the minor axis of the ellipse is at least 1 inch in length.

4. The acoustic-electric sensor system of claim 2, wherein a length of the major axis of the ellipse is greater than the length of the saddle, and a length of the minor axis of the ellipse is at least 8 times the width of the saddle.

5. The acoustic-electric sensor system of claim 1, wherein:

the feedback suppression acoustic sensor is disposed sufficiently remote from the saddle such that the feedback suppression acoustic sensor is configured to primarily detect sound board vibrations of the acoustic-electric stringed instrument while substantially avoiding string vibration signatures of the acoustic-electric stringed instrument at the saddle, and, the feedback suppression acoustic sensor is configured to detect string vibrations of the acoustic-electric stringed instrument at amplitude $FB_{str}$, while the main acoustic sensor is configured to detect string vibrations of the acoustic-electric stringed instrument at amplitude $MN_{str}$, wherein the ratio of $$\frac{MN_{str}}{FB_{str}}$$

is at least 6 dB.

6. The acoustic-electric sensor system of claim 1, wherein the main acoustic sensor and the feedback suppression acoustic sensor comprise respective piezoelectric acoustic transducers.

7. The acoustic-electric sensor system of claim 6, wherein the main acoustic sensor and the feedback suppression acoustic sensor are mechanically coupled to the acoustic-electric stringed instrument, such that the feedback suppression sensor is oriented in an opposite polarity configuration with respect to the main acoustic sensor.

8. The acoustic-electric sensor system of claim 6, wherein the feedback suppression acoustic sensor is disposed at a location on the acoustic-electric stringed instrument such that the second signal component is in a 180° out-of-phase relationship with the third signal component.

9. The acoustic-electric sensor system of claim 1, wherein the main acoustic sensor is arranged in at least one of a Undersaddle Transducer (UST), a Soundboard Transducer (SBT), or Bridge Plate Pickup configuration.

10. An acoustic-electric sensor system comprising:

a main acoustic sensor configured to operably couple to an acoustic-electric stringed instrument and configured to output a main signal that comprises:

a first signal component that represents string vibrations of the acoustic-electric stringed instrument; and, a second signal component that represents sound board vibrations of the acoustic-electric stringed instrument;

a feedback suppression acoustic sensor configured to operably couple to the acoustic-electric stringed instrument and configured to output a feedback suppression signal that comprises a third signal component that represents sound board vibrations of the acoustic-electric stringed instrument; and, a mixing module configured to receive the main signal and the feedback suppression signal, and configured to mix the main signal with the feedback suppression signal to generate a mixed output signal, wherein when the mixed output signal is generated, the second signal component at least partially cancels out with the third signal component in the mixed output signal to substantially attenuate the second signal component in the mixed output signal.

11. The acoustic-electric sensor system of claim 10, wherein the main acoustic sensor and the feedback suppression acoustic sensor comprise respective piezoelectric acoustic transducers.

12. The acoustic-electric sensor system of claim 10, wherein the mixing module comprises a capacitive mixing circuit operably coupled to an output of the main acoustic sensor and an output of the feedback suppression acoustic sensor, and configured to capacitively couple the main signal with the feedback suppression signal to generate the mixed output signal.

13. The acoustic-electric sensor system of claim 12, wherein the capacitive mixing circuit comprises a variable capacitor configured to selectively adjust a level of capacitive coupling between the main signal and the feedback suppression signal.

14. The acoustic-electric sensor system of claim 12, wherein the capacitive mixing circuit comprises:

a first capacitor comprising a first terminal and a second terminal wherein the first terminal is electrically coupled to the output of main acoustic sensor;

a second capacitor comprising a third terminal and a fourth terminal, wherein the third terminal is electrically coupled to the output of the feedback suppression acoustic sensor;

a summing junction electrically coupled to both the second terminal and the fourth terminal and configured to sum the main signal and the feedback suppression signal; and, an output line electrically coupled to the summing junction and configured to output the mixed output signal.

15. An acoustic-electric sensor system comprising:

a main acoustic sensor configured to operably couple to an acoustic-electric stringed instrument and configured to output a main signal that comprises:

a first signal component that represents string vibrations of the acoustic-electric stringed instrument; and, a second signal component that represents sound board vibrations of the acoustic-electric stringed instrument;

a feedback suppression acoustic sensor configured to operably couple to the acoustic-electric stringed instrument and configured to output a feedback suppression signal that comprises a third signal component that represents sound board vibrations of the acoustic-electric stringed instrument; and, means for mixing the main signal with the feedback suppression signal to generate a mixed output signal, wherein when the mixed output signal is generated, the second signal component at least partially cancels out with the third signal component in the mixed output signal to substantially attenuate the second signal component in the mixed output signal.

16. The acoustic-electric sensor system of claim 15, further comprising an attenuator operably coupled to the means for mixing and configured to attenuate the mixed output signal.

17. The acoustic-electric sensor system of claim 16, wherein the attenuator comprises a capacitive attenuator circuit having a user-selectable capacitance value operable to control a level of attenuation of the mixed output signal.

18. The acoustic-electric sensor system of claim 15, wherein the means for mixing is configured to selectively adjust a level of capacitive coupling between the main signal and the feedback suppression signal.

19. The acoustic-electric sensor system of claim 15, wherein the feedback suppression acoustic sensor is configured in a 180° out-of-phase relationship with the main acoustic sensor.

* * * * *